US006685002B1

(12) United States Patent
Nurnberg et al.

(10) Patent No.: US 6,685,002 B1
(45) Date of Patent: Feb. 3, 2004

(54) METHOD OF ESCALATOR MODERNIZATION

(75) Inventors: Thomas Nurnberg, Coal Valley, IL (US); Theodore Martel, Coal Valley, IL (US); Andrew Dochterman, Coal Valley, IL (US)

(73) Assignee: Kone Corporation, Hyvinkaa (FI)

( * ) Notice: Subject to any disclaimer, the term of this patent is extended or adjusted under 35 U.S.C. 154(b) by 0 days.

(21) Appl. No.: 10/270,053

(22) Filed: Oct. 15, 2002

(51) Int. Cl.[7] ..... B66B 9/12
(52) U.S. Cl. ..... 198/321; 198/326
(58) Field of Search ..... 198/321, 333, 198/326, 330

(56) References Cited

U.S. PATENT DOCUMENTS 2,936,872 A * 5/1960 Kneipp ..... 198/321
4,175,653 A * 11/1979 Kubota et al. ..... 198/321
4,535,880 A * 8/1985 Boltrek ..... 198/330
4,811,829 A * 3/1989 Nakazawa et al. ..... 198/326
4,832,169 A * 5/1989 Goto ..... 198/326
6,247,574 B1 * 6/2001 Yamaguchi et al. ..... 198/326

FOREIGN PATENT DOCUMENTS

GB 2 121 748 * 1/1984 ..... 198/326

* cited by examiner

*Primary Examiner*—Douglas Hess
(74) *Attorney, Agent, or Firm*—Birch, Stewart, Kolasch & Birch, LLP

(57) ABSTRACT

A method of modernizing an escalator using modular components. The mechanical and electrical parts of an existing escalator are removed, leaving only the structural truss framework and cross members as well as all external parts, such as external panels, that interface with the building. A single module is placed at the top of the escalator and another module at the bottom. A plurality of incline modules are placed in the central inclined part of the escalator, at each cross member. By utilizing these modules, the assembly of the escalator is simplified. Furthermore, an entirely new escalator system using the latest technology may be installed rather than merely installing new parts in an old system.

14 Claims, 4 Drawing Sheets

METHOD OF ESCALATOR MODERNIZATION

BACKGROUND OF THE INVENTION

1. Field of the Invention

This invention relates generally to a method for modernizing escalators and more particularly to a method for modernizing escalators using a small number of modules.

2. Description of the Background Art

Escalators are widely used in many kinds of building, including commercial buildings and in transportation terminals to move people quickly and efficiently from one floor to another. Escalator systems are designed to remain in use for many years. Often the escalator is designed at the same time as the building and they are built to fit the design of the building. However, like all mechanical devices, parts of the escalator system wear out over time requiring replacement. Repairs can be conducted on individual parts as necessary. It is also desirable to replace an individual part with an upgraded part where possible to comply with current escalator codes, etc.

However, in repairing individual parts of the system, the system as a whole is not modernized and newest technical and safety advancements and efficiencies are not incorporated into the system. To completely modernize a system to state-of-the-art conditions, it is necessary to tear out the old installation and replace it with an entirely new installation, including reconfiguring the building around the escalator installation in order to replace the system, which is expensive and time consuming. The only other alternative is to replace all of the individual parts with new parts, so that at least all of the parts are new. But since the system is not designed to accommodate new advancements, merely a new version of an old escalator is obtained. Thus, the technology for such a system would still be old even though the parts are new.

In some modern installations of moving walkways, which are often used in airport terminals and other similar situations where customers must travel a long distance within the building, a modular arrangement is used for simplifying the installation of the walkway. In such an arrangement, a prebuilt module is supplied from the factory which includes the motor, controls and other mechanisms for driving the moving walkway at one end of the installation. Another module which contains a mechanism for returning the moving walkway is placed at the other end of the installation. The intervening space may then be built between the two modules and may even involve some modular construction where possible. The advantage of using such modules is that most of the mechanism can be manufactured in the factory where assembly is faster, easier and cheaper and where appropriate tools and facilities are present to make the assembly easy. In these situations, the modules typically include the truss framework as well as the mechanism itself. The modules and truss framework can be installed in the building at each end, as a unit, simplifying construction.

While such modular construction has been utilized in moving walkways, for example, in new installations, using modules to retrofit an existing escalator structure in order to bring new technology and modernization to the system is not available. It is necessary to either tear out the entire installation and start anew with an entirely new installation along with accompanying changes to the building interface or it is necessary to replace individual parts, which is time consuming and expensive.

SUMMARY OF THE INVENTION

Accordingly, the present invention provides a method for modernizing escalator systems.

The present invention further provides a method for retrofitting and upgrading existing escalator systems.

The present invention further provides a method for installing a new escalator system into an existing escalator framework in an efficient manner.

The present invention still further provides a method for modernizing an escalator system by installing state-of-the-art modules rather than individual parts.

The present invention still further provides a method for modernizing an escalator system simply and inexpensively utilizing an upper module, lower module and intermediate modules.

The present invention also provides a product for modernizing an escalator system.

Briefly, the present invention accomplishes this by providing a modern escalator system in a series of modules. The old escalator system is removed while leaving the truss structural framework and cross members in place. The modules are installed easily within this truss framework without changing the existing building interface and/or structure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
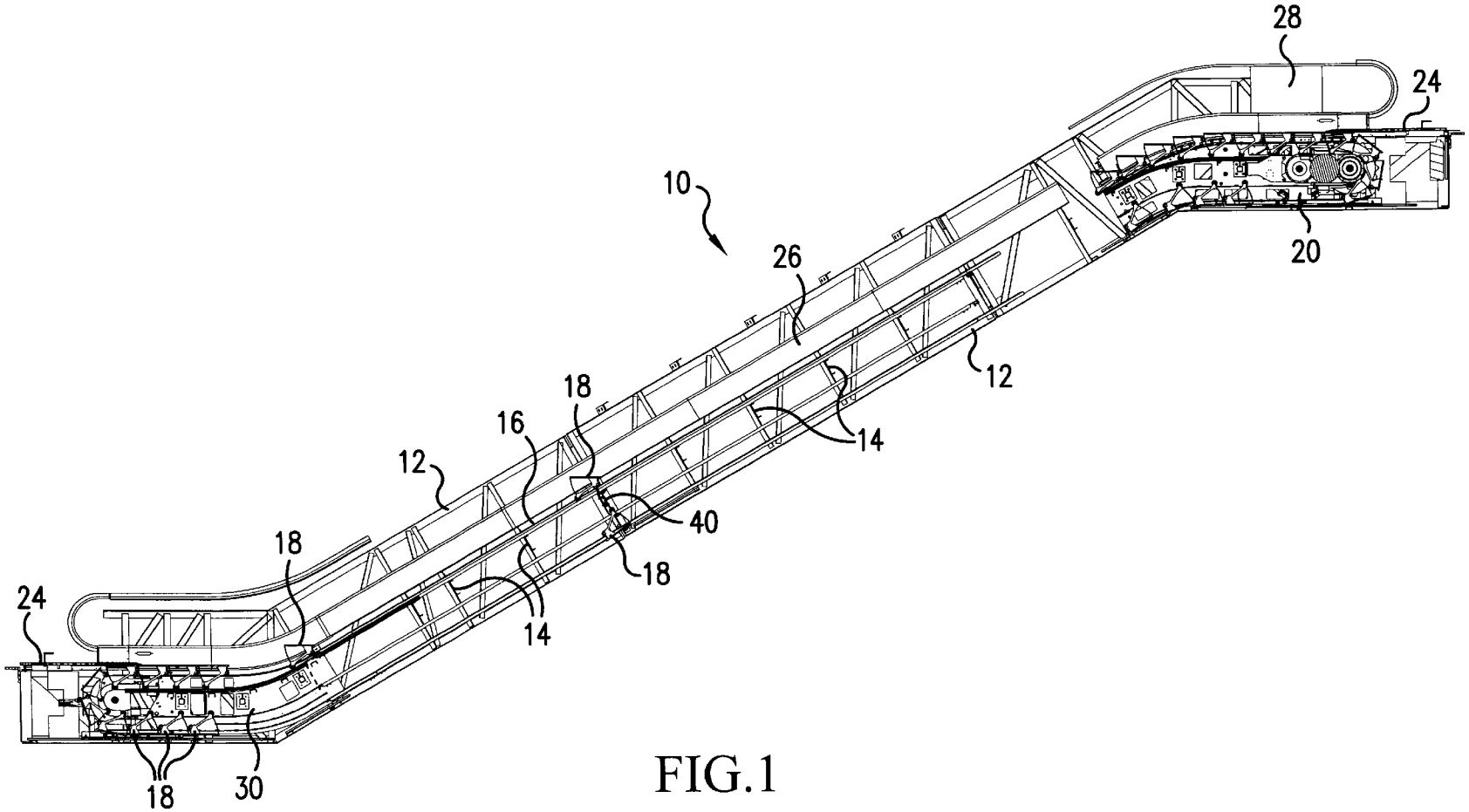
FIG. 1 is a schematic of an overall escalator system in an existing truss installation according to the present invention.

Referring now to the drawings, wherein like reference numerals designate identical or corresponding parts throughout the several views, and more particularly to FIG. 1 thereof, wherein numeral 10 designates an escalator system modernization according to the present invention. When built, such a system modernization utilizes the existing truss arrangement 12 extending longitudinally along both sides of the escalator to provide a framework on which the system modernization modules are mounted. The truss extends not only on the inclined central part, but also along the flat sections at the top and bottom. This truss arrangement is made of metal pieces welded together or otherwise attached in a structural fashion. This truss system is mounted to the structure of the building so as to be integral therewith. This mounting may be accomplished using bolting, welding or other traditional methods.

The longitudinal truss members extending up the sides of the inclined portion are also joined to each other using cross members 14 which extend transversely to the longitudinal trusses. These cross members are made of metal and in particular can be metal channelshaped elements. Cross members are welded or otherwise attached to the truss in a known manner. Such channel members have a central portion which lies against one of the pieces of the truss and is attached thereto. The side portions extend out from the central portion. The upper one of these side portions may then be used as a place to set the track 16 on which the steps 18 of the escalator ride.

When it is desired to modernize the escalator system according to the present invention, all of the old systems are removed, including the drive system, the step band system, handrail drive system, the track system and the electrical system. The truss 12 remains in place and accordingly no building interface modifications are necessary. In addition to the longitudinal truss elements, most of the cross members are also left in place, except where it is necessary to remove them at the ends to receive the modules. It is also not necessary to remove the outer cladding, that is the vertical decorative panels which are on the outside of the truss and which interface with the building. However, the escalator system is completely removed while the truss members of the existing installation remain in place.

In prior art systems, it would be necessary at this point to start to rebuild piecemeal a new escalator within this framework. However, according to the present invention, the process is simplified by utilizing modules which are preassembled and fixtured in the factory. First, upper module 20 is placed at the upper end of the escalator framework. This module includes the drive system, which provides a source of power for moving the steps. This module is placed in the existing truss framework and attached thereto using bolts, welding or other traditional methods. Since all of these parts within the module are built, assembled and tested in the factory before being moved onto the job site, it is only necessary to move the module into position and connect it to the truss framework. It is not necessary to individually connect separate parts, to set tolerances and test the device before it can be used.

The upper modules may consist of three or more assemblies including the drive station, which includes the motor and driving arrangements, the truss interface, which provides the connections to the truss framework and the upper track subassembly which includes the beginning of the track for receiving the steps. Other assemblies included in the module may be the handrail drive system and the skirt mounting system. The upper module extends into the inclined section a short distance as seen in FIG. 1. Since this module is preassembled and fixtured in the factory, its installation is simplified.

Likewise, a lower module 30 is attached to the truss framework at the lower end of the escalator. This module may also consist of three or more assemblies including a lower reversing station, which receives the steps, turns them over and returns them back to the drive station on the opposite track. It also includes a truss interface to allow the module to be attached to the truss framework in the same manner as the upper module and a track subassembly which contains the lower ends of the track. Other assemblies included in the module may be the handrail return system and the skirt mounting system. This likewise can be bolted or welded to the truss framework. The lower module also extends into the inclined section so that the remaining inclined section is linear. The modules can be centered and adjusted to the existing floor height using jackscrews which are part of the truss interface module. Since this module is preassembled and fixtured in the factory, its installation is simplified.

Once the two modules at the top and bottom of the escalator are aligned, it is then possible to install the incline modules therebetween. These modules are placed and attached at every cross member using bolts or welding or other similar standard techniques. Each incline module is in the form of a stanchion assembly which is mounted on the cross member. These are preassembled and fixtured in the factory. This assembly is made in the shape of an H with two upright portions and a horizontal portion joining the uprights. The upright portions are arranged to just fit between opposite truss members. The horizontal member lies adjacent the original cross member and is attached thereto. This assembly is shown in FIG. 1 at only one of the original cross members as indicated by numeral 40. However, in practice one would be added at each of the cross members 14.

The incline module is designed to provide easy locating and positioning for the various systems mounted thereon, such as the handrail system, track skirt system, etc. Once the modules are aligned in position, it is not necessary to align these systems. The module provides specific locations for the systems, so that it is only necessary to place them in position and bolt them. All alignment is thus predetermined in the factory.

Figure 2:
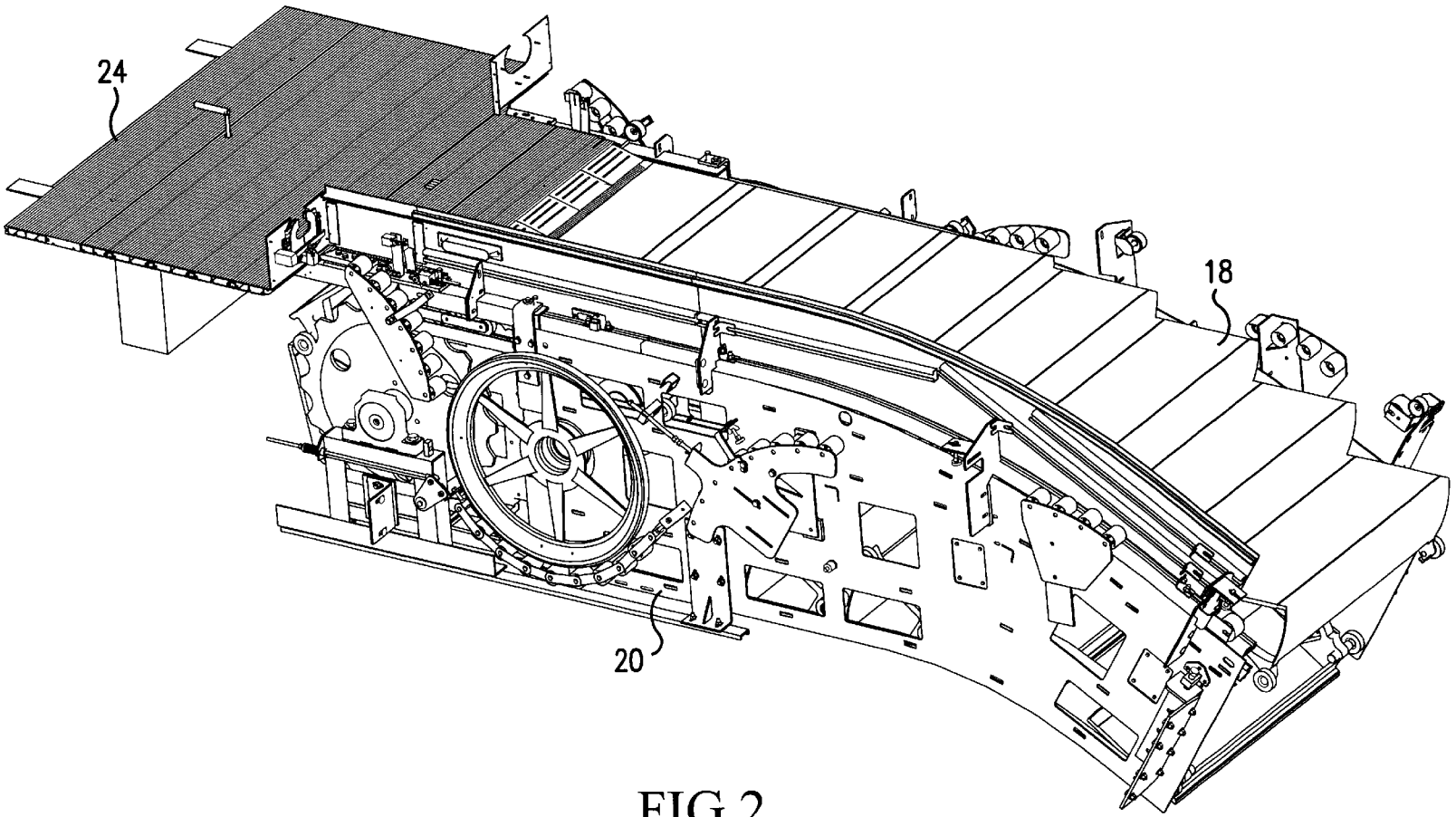
FIG. 2 is a perspective view of the upper system module according to the present invention.

FIG. 2, shows the upper module 20 in more detail. This figure also shows a series of steps 18 mounted for operation and a series of removable access panels 24 which also operate as the landing area for passengers entering or leaving the escalator at the upper end. As can be seen, the module includes a complete unit for driving the escalator from the upper end.

Figure 3:
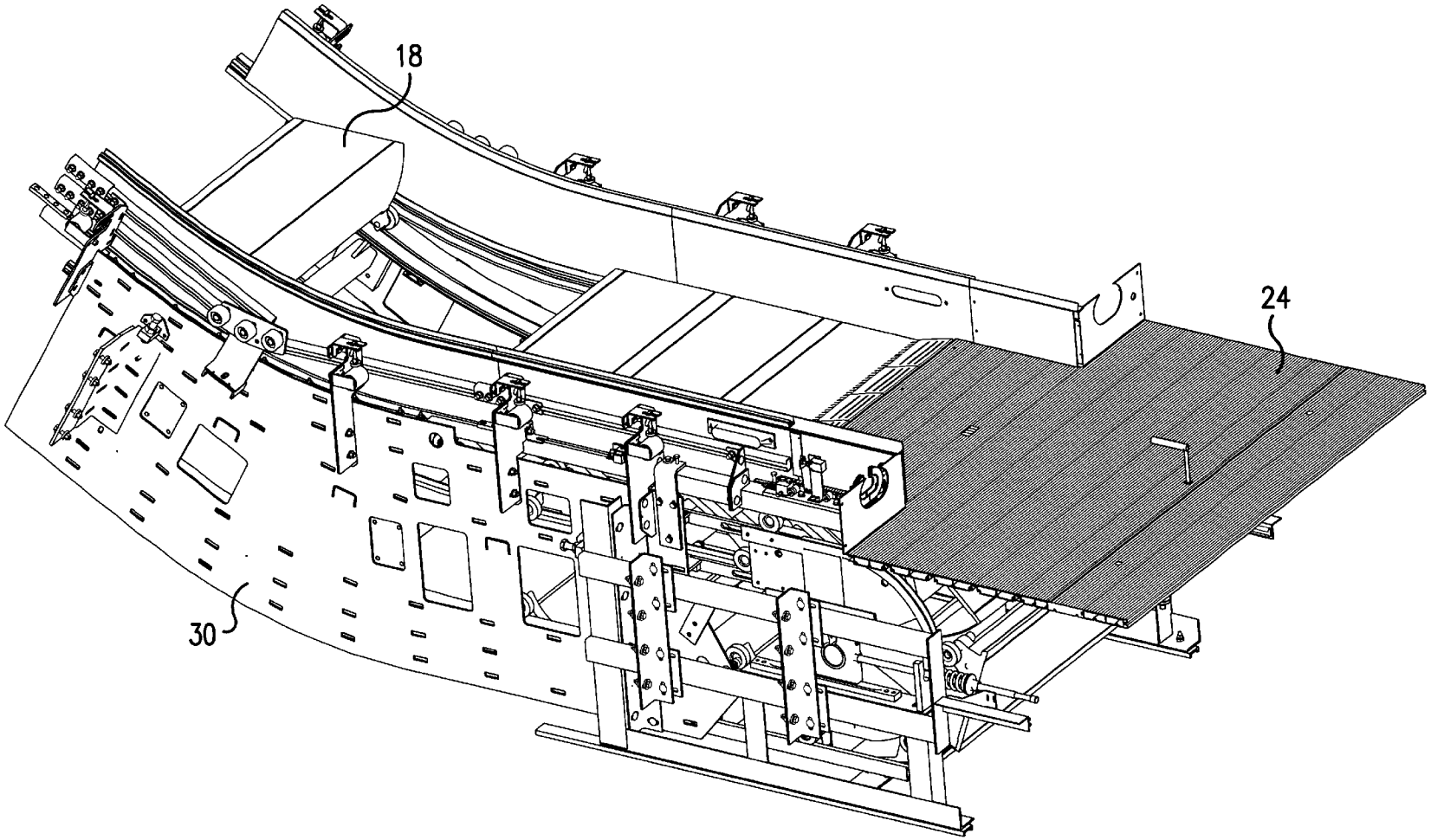
FIG. 3 is a perspective view of the lower system module according to the present invention.

Likewise FIG. 3 shows the lower module 30. It also shows a series of steps 18 and access panels 24 which act as the landing area for passengers entering or leaving at the lower end of the escalator. As can be seen, this unit acts as a complete device for returning the escalator at the bottom end.

Figure 4:
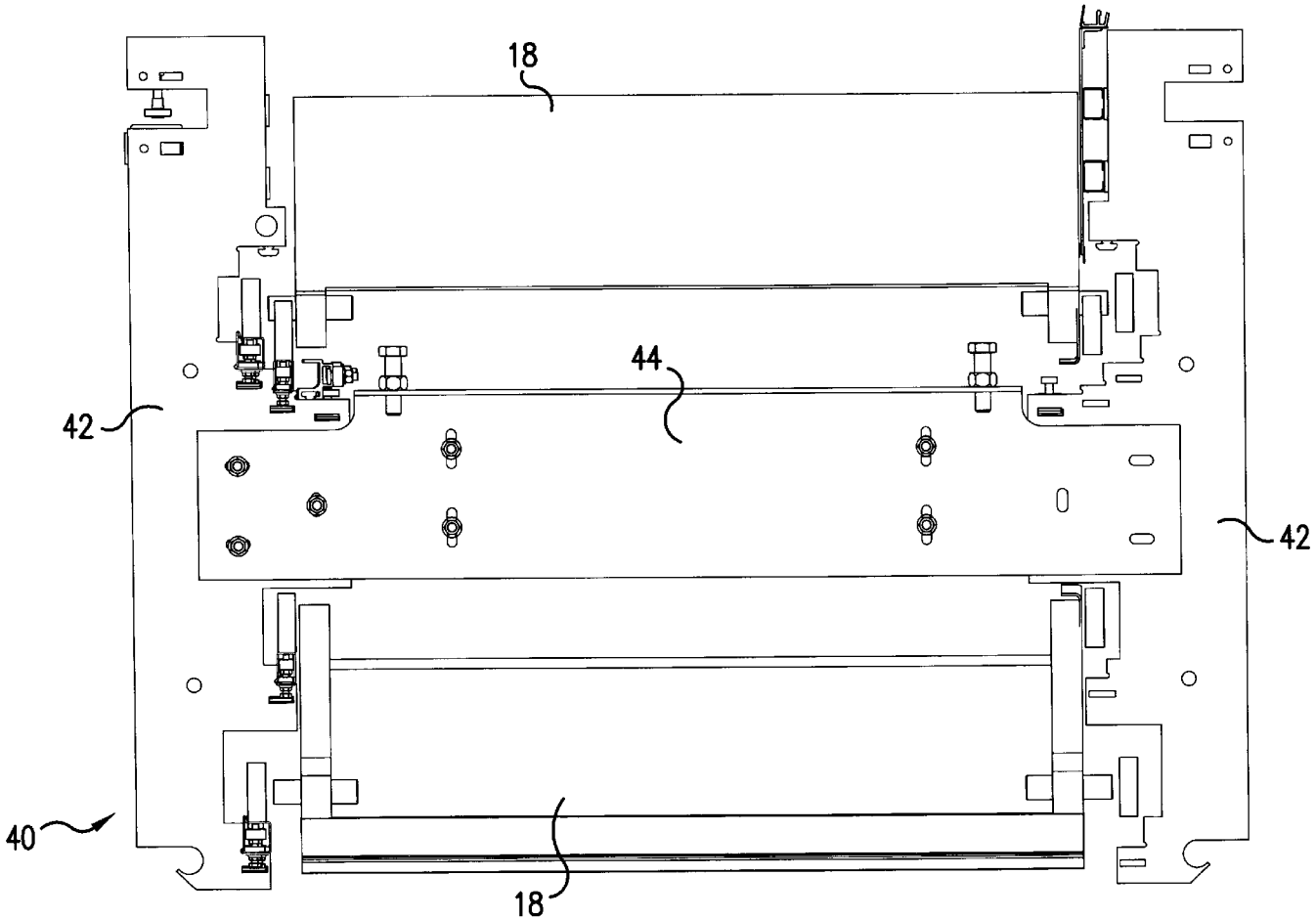
FIG. 4 is a perspective view of an incline system module according to the present invention.

FIG. 4 shows the incline modules or stanchions 40. Each stanchion includes two upright elements 42 and horizontal member 44. As can be seen, various bolts are placed in the stanchion for attaching to the existing cross member, which are adjustable within slots. The stanchion is shown in the shape of an H which fits between the existing truss frameworks. FIG. 4 also shows 2 steps 18, one above the horizontal member and one below. The lower step is inverted and is returning to the starting point of the escalator while the upper step is in configuration for carrying a passenger.

The incline modules are aligned with the upper and lower modules using string lines or laser alignment, using preset alignment holes in the modules. The incline modules are adjusted to the appropriate height so as to retain the existing step nose line. The track 16 is then installed between the upper and lower modules by being located and mounted on the upright sections of the incline modules. The step chain is installed between the upper and lower modules and the steps are installed. Skirts 26 which are panels next to the step on the side walls of the escalator and step guides can then be installed as well as inner panels 28. Skirts and step guides rest against horizontal and vertical surfaces of the incline module. The step and hand rail guidance components as well as the support bracketing for the skirts are already present since they are pre-fixtured integral parts of the subject modules.

While the installation of the new components of the escalator still involves considerable work, the use of such modules greatly simplify the amount of work that must be done in the field, improves quality and eliminates a number of installation problems. It greatly reduces the amount of installation time in the field, reduces cost and provides a stateof-the-art product since it is largely assembled and controlled in the factory. Further, by utilizing system modules, an entirely new escalator using state-of-the-art design and techniques is possible so that a new escalator is being added within the old truss framework. Thus, the customer receives not only a new escalator, but one having the latest features. Under previous rebuilding systems, new parts may be used, but the escalator would utilize the technology which existed at the time of its original building rather than being updated.

As noted above, the upper module and lower module are each considered to have three assemblies. However, it is clear the number of assemblies that are involved can be varied and that no matter how many assemblies are involved, the module as a whole is placed in position in one operation. It may be envisioned, for example, that the drive station and the reversing station are made so as to be usable for a number of different escalator modernization programs with the truss interface assembly and track subassemblies being adjusted for each individual project. However, no matter how the individual assemblies are arranged or manufactured, the use of a single module at the upper end, a single module at the lower end and a plurality of modules for the incline section makes the modernization project of an escalator simpler, more efficient and allows the final product to have state-of-the-art technology.

Numerous additional modification and variations of the present invention are possible in light of the above teachings. It is therefore to be understood that within the scope of the invented claims, an invention may be practiced otherwise and as specifically described herein.

What is claimed is:

1. A method of modernizing an escalator comprising:

removing mechanical and electrical components from an existing escalator system, leaving a truss framework including cross members from the existing escalator system;

installing a first module in said truss framework at a top of the escalator;

installing a second module in said truss framework at a bottom of the escalator;

installing a plurality of incline modules between said first module and said second module, along an incline portion of said escalator, including placing each incline module just inside said truss framework and attaching a horizontal portion of each incline module to one of said cross members; and installing track between said first and second modules on said plurality of incline modules.

2. The method according to claim 1, wherein said first module is an upper module including a drive station.

3. The method according to claim 2, wherein said upper module further includes a truss interface and a track subassembly.

4. The method according to claim 3, wherein said upper module further includes a handrail drive assembly and a skirt mounting assembly.

5. The method according to claim 1, wherein said second module is a lower module and includes a lower reversing station.

6. The method according to claim 5, wherein the lower module further includes a truss interface and a track subassembly.

7. The method according to claim 6, wherein the lower module further includes a handrail return assembly and a skirt mounting assembly.

8. The method according to claim 1, wherein each incline module is a stanchion assembly including two upright portions and a horizontal portion extending between the upright portions.

9. The method according to claim 8, wherein each incline module further includes a handrail system and a track skirt system.

10. An escalator modernized by the process of claim 1.

11. The method according to claim 1, further comprising installing a step chain and a plurality of steps after installing said track.

12. The method according to claim 1, wherein said incline modules provide locations, positioning and alignment for systems mounted thereon.

13. A modernized escalator system, comprising:

a truss framework from an existing escalator installation, including cross members;

a first module containing a drive station mounted at one end of said truss framework;

a second module including a reversing station mounted at an opposite end of said truss framework;

a plurality of incline modules placed inside said truss framework, each having a horizontal portion connected to a cross member of said truss framework;

whereby said existing escalator system is modernized by including new first, second and incline modules within an existing truss framework.

14. A kit for modernizing an escalator system, comprising:

a first module including a drive station;

a second module including a reversing station;

a plurality of incline modules each of said incline modules including two upstanding elements and a horizontal element joining said upstanding elements with said horizontal element being attached to a cross member of a truss framework of an existing escalator;

wherein said first module, said second module and said plurality of incline modules fit within said truss framework.

* * * * *